US007780165B2

(12) United States Patent
Cudlipp

(10) Patent No.: US 7,780,165 B2
(45) **Date of Patent: *Aug. 24, 2010**

(54) GAMING SYSTEM

(75) Inventor: William Owen Cudlipp, 119 George St, Sydney, New South Wales (AU) 2000

(73) Assignee: William Owen Cudlipp, Mosman, New South Wales (AU)

( * ) Notice: Subject to any disclaimer, the term of this patent is extended or adjusted under 35 U.S.C. 154(b) by 751 days.

This patent is subject to a terminal disclaimer.

(21) Appl. No.: 11/383,145

(22) Filed: May 12, 2006

(65) Prior Publication Data

US 2007/0246883 A1 Oct. 25, 2007

(30) Foreign Application Priority Data

Apr. 21, 2006 (AU) ..... 2006902126

(51) Int. Cl.
*A63B 71/00* (2006.01)

(52) U.S. Cl. ..... 273/144 B

(58) Field of Classification Search ..... None
See application file for complete search history.

(56) References Cited

U.S. PATENT DOCUMENTS 2,091,883 A * 8/1937 Rochwarg ..... 273/399
2,385,980 A * 10/1945 Fostos ..... 273/399
4,403,775 A * 9/1983 Chaput ..... 273/144 B
4,508,346 A * 4/1985 Salvucci ..... 273/144 B
4,786,056 A * 11/1988 Dunnigan ..... 273/144 A
4,824,113 A * 4/1989 Lange ..... 273/144 B
4,948,133 A * 8/1990 Helm et al. ..... 273/124 A
4,961,578 A * 10/1990 Chateau ..... 273/144 R
5,062,635 A * 11/1991 Tse et al. ..... 273/144 A
5,088,737 A * 2/1992 Frank et al. ..... 463/18
5,702,101 A * 12/1997 Russell ..... 273/144 B
6,152,448 A * 11/2000 Cudlipp ..... 273/144 R
6,322,071 B1 * 11/2001 Chaaban ..... 273/138.4
6,435,501 B2 * 8/2002 Naden ..... 273/144 A
6,902,479 B1 * 6/2005 D'Avanzo ..... 463/18
7,316,610 B2 * 1/2008 Seelig et al. ..... 463/17
7,335,103 B2 * 2/2008 Seelig et al. ..... 463/22
7,413,511 B2 * 8/2008 Seelig et al. ..... 463/22

FOREIGN PATENT DOCUMENTS

JP 10005393 A 1/1998
WO WO 9748461 A1 12/1997

* cited by examiner

*Primary Examiner*—Gene Kim
*Assistant Examiner*—Dolores Collins
(74) *Attorney, Agent, or Firm*—David W. Maher; TechLaw LLP

(57) ABSTRACT

The present invention provides a gaming apparatus adapted for substantially continuous play, comprising a first set of elements divisible into two or more distinguishable subsets; a second set of destinations divisible into two or more distinguishable subsets; selection means for selecting at random one element from the first set; association means for associating the randomly selected one element at random with one destination of the second set; and return means for returning the randomly selected one element to the start position.

The present invention further provides adapting the above apparatus to an electronic gaming format.

23 Claims, 4 Drawing Sheets

GAMING SYSTEM

FIELD OF THE INVENTION

The present invention relates to a game and more particularly to a game of chance suitable for use in entertainment of one or more players.

The invention has been developed primarily as a regenerable or continuous game of chance and will be described hereinafter with reference to this application. However, it will be appreciated that the invention is not limited to this particular field of use.

BACKGROUND OF THE INVENTION

Any discussion of the prior art throughout the specification should in no way be considered as an admission that such prior art is widely known or forms part of the common general knowledge in the field.

Games in which the outcome is determined by chance are well known. Some such games have even been specifically designed for play before a television audience.

Games of chance may be divided into two groups: In one group, the number of possible outcome combinations is generally very high, such that the chance of a match with a particular user-selected combination is very small. Accordingly, there are relatively low numbers of 'winners' per draw, with the result that the winnings may be a relatively large multiple of the stake. For example, in "Lotto", a succession of uniquely numbered counters is drawn at random from the overall pool of such counters. The draw is conducted in a television studio, the result of each draw being displayed to a television audience. To prolong excitement, counters may be drawn in succession, or over a period. If a member of the audience is able to match the drawn number combination with their user-selected predetermined combination, that audience member is a game winner. In other lotteries, for example, a sequence of, say, 6 digits is drawn to yield a random 6-digit number. It is noteworthy, in this context, that games having a relatively high number of combinations often incorporate consolation prizes. Players who collect these consolation prizes often claim to have "won".

An apparatus suitable for games of this kind is described in United States patent No. U.S. Pat. No. 4,373,728, whereby numbers may be selected at random. For example, six numbers may be selected from 40, to designate a winning lottery number pool. There are 40 balls, six being of a different colour to the remaining 34; these are mixed randomly and then fall arbitrarily into a conduit whereby all 40 balls are arranged in a random sequence which is fed in succession into a wheel having peripheral receptacles, such that each receptacle successively receives the next ball of the sequence. Each receptacle is numbered and those numbers corresponding to the six differently coloured balls define the six numbers selected as the random outcome. By turning the wheel slowly disclosure of the outcome of the draw may be prolonged.

Games in this first group have a fixed stake and tend to be perceived by players as having an outcome determined solely by luck.

The second broad group includes games such as roulette, in which fewer combinations are available. With games of this group, a player may wager different amounts on chosen outcomes for each "play" or "spin". For example, a player may bet on whether the roulette ball will select a particular one of 36 numbered slots; an odd or even number; a black or red number; and so on.

There are 38 numbered slots on an "American" style roulette wheel; said numbers comprise 1 through 36, "0" and "00". The original "European" style roulette wheel has 37 numbered slots: 1 through 36 and "0". Curiously, although the wheels in Australian casinos typically have 37 numbered slots, the games are often called "American" roulette. In such games, the odds in favour of various possible outcomes are readily appreciable such that players feel they can optimise their chances of winning by systematic play. As a result, they feel that one can exercise skill in adjusting wagers according to odds. Such games are considered to be more participatory, engaging and entertaining than games falling within the first broad group described above.

Most "experts" agree that systematic play cannot optimise or enhance one's chance of winning at roulette. A number do assert, however, that the use of rigid staking plans and "stop loss" limits do facilitate long term systematic play. Furthermore, each successive spin takes an increment of time, thereby extending the excitement of each game. However, the maximum odds for any particular wager are generally only a small multiple of the overall wager. For example, 35-to-1 for a 36-compartment roulette wheel having one non-paying slot.

Great Britain Patent No. GB 1,113,668 discloses a roulette-type game in which at least two identifiably different balls are used in succession. This facilitates a player placing a "doubles bet" (i.e. equivalent to betting on the outcome of a combination of two successive plays of the wheel), thereby increasing the range of odds available and extending the excitement over a longer period.

United States patent No. U.S. Pat. No. 4,824,113 discloses a game in which six groups of differently coloured balls are simultaneously randomly mixed in six ganged chambers. A gate is activated and one coloured ball from each group is selected at random, thereby yielding a combination of six selected colours. By duplicating colours, a range of odds for various combinations can be provided for each spin. Since the outcome is determined virtually instantaneously upon mixing, this game lacks the excitement of most games in the second group.

There remains an unsatisfied demand for games that provide an apparent simplicity in assessing the odds of various outcomes, which provide scope for wagers covering a range of odds spanning from high, to low probability, and which are exciting to play.

Further, a limitation of games such as "Lotto" is that the selected balls need to be manually removed from the apparatus and re-loaded into the starting position prior to a new game beginning. Alternatively, as each successive ball is selected, the odds of a preselected ball being drawn next must necessarily alter. This is both time and labour-intensive, and manual handling of the gaming balls by the dealer may give rise to a perceptible lack of integrity. Accordingly, there would appear to be a need for a gaming system adapted for continuous play.

It is an object of the present invention to overcome or ameliorate at least one of the disadvantages of the prior art, or to provide a useful alternative.

It is an object of the present invention in a preferred form to provide a new game, which is easy to play, and provides an alternative to known games. It is an object of the present invention in another preferred form to provide a game that is relatively fast, regenerable, adapted for continuous play, and of relatively high integrity with respect to the games of the prior art.

It has been observed world-over, that a majority of casino patrons often closely watched "table games", but actually only played electronic gaming machines ("EGMs"). One possible explanation for this may be that these patrons were intimidated by the relatively intricate or arcane processes of standard table games, such as Roulette. Such an explanation has been confirmed, subsequently, through extensive, albeit informal, research. The majority of Australian casinos have been monitored by the Applicant, and the above impression has been reaffirmed time after time.

One aim of the present application is to provide a game bridging a universally understood gamble such as "Lotto" and regular casino table games having a perceived barrier of intimidation; and to offer a new form of gaming intended to complement, rather than cannibalise existing casino games. Thus, the present inventive concept could be described as a marriage of Lotto and Roulette. This description is, however, far too simplistic as the game actually incorporates a flexibility that takes it well beyond the simple merging of the two games.

DISCLOSURE OF THE INVENTION

According to a first aspect of the present invention there is provided a gaming apparatus adapted for substantially continuous play, said apparatus comprising:

- a first set of elements divisible into two or more distinguishable subsets, thereby to define a start position;
- a second set of destinations divisible into two or more distinguishable subsets;
- selection means for selecting at random one element from said first set;
- association means for associating said randomly selected one element at random with one said destination of said second set; and
- return means for returning said randomly selected one element to said start position.

Preferably, said first set of elements is a plurality of balls. Preferably, said set of balls is divided into a plurality of subsets, each subset being distinguishable from a respective other subset.

Preferably, said second set of destinations is a set of compartments or slots defined on a wheel. Preferably, each said destination is distinguishable from respective other destinations by means including, but not limited to: numerical indicia, names of people, places, things, and symbols, such as flora and fauna icons.

Preferably, said wheel is radially partitioned into segment-shaped upwardly open compartments. Preferably, first set of elements are balls, and wherein one said ball selected at random from said first set is allowed to travel in a path which includes at least one random bounce prior to said randomly selected ball settling at random in one of said compartments.

The gaming apparatus preferably further comprises means to set said wheel in rotation prior to allowing said randomly selected ball to settle at random into one of said compartments.

Preferably, said wheel comprises a central boss. Preferably, said central boss rotates with said wheel. Alternatively, said central boss counter-rotates with respect to said wheel.

The gaming apparatus preferably further comprises:

- a chamber;
- means for randomly mixing said first set of elements in said chamber; and
- means for removing one randomly-selected element from said chamber.

Preferably, said randomly selected ball bounces in a substantially vertical plane prior to settling at random into one of said compartments.

Preferably, said return means is an airlift, thereby to lift and deposit said ball from said destination compartment to said starting position.

Preferably, one or more said destination compartments comprise a false bottom, said false bottom selectively openable to allow passage of said ball into said return means for deposit to said starting position. Preferably, said return means is an air conduit. Alternatively, said return means comprises mechanically lifting and depositing said ball in said starting position.

Preferably, said return means is manually operable. Alternatively, said return means is automatically operable. Preferably, said automatically operable return means is actuated at predetermined intervals. Preferably, said predetermined intervals correspond to the time said ball resides in said destination compartment.

Preferably, said time said ball resides in said destination compartment is determined by a sensor within each said destination compartment.

In a preferred embodiment of the invention, the first set of elements are balls divided into a plurality of subsets, each subset of balls being of a colour or appearance differing from each other subset. The balls are originally in a starting position. A randomly selected ball from the first set is allowed to fall at random onto a wheel having a plurality of destination compartments, e.g. a wheel partitioned into numbered segmental compartments. The randomly selected ball of the first set is allowed to bounce until it settles into one of the compartments. It thereby becomes associated at random with one of the numbered destination compartments.

A player who is able in advance of the game to guess at the colour of the ball selected and/or to guess the number of the compartment into which the ball settles is a winner. Players may wager on which coloured ball is selected from the first set, or on which destination the selected ball becomes associated with, or on a combination of ball colour and destination.

Once the result has been recorded, the ball is then returned to the starting position such that another game can begin, with the same odds as the first game. Preferably, the means of returning the ball to the starting position is by way of mechanical levitation or air lift such that relatively little labour and time intensity is required, and that dealer handling may be substantially eliminated. The wheel can remain in continuous motion, with or without slowing, if desired.

According to a second aspect of the present invention there is provided a gaming concept, said concept comprising:

- adapting the apparatus according to the first aspect of the present invention to an electronic gaming format;
- enabling one or more punters to bet singularly or simultaneously upon an outcome, said outcome having predefined odds; and
- automatically assessing each said outcome relative to each said bet and said odds, thereby to facilitate automatic electronic payment of a winning stake corresponding to said predefined odds.

A number of other characteristics, advantages, and/or associated novel features of the present invention will become clear from the description and illustrations provided herein.

BRIEF DESCRIPTION OF THE DRAWINGS

The drawings are illustrative only. In particular, the embodiments included and described are those that best depict the principles, features, and characteristics of the invention and its practical application. Accordingly, all variations are contemplated as being part of the invention, limited only by the scope of the appended claims.

A preferred embodiment of the invention will now be described, by way of example only, with reference to the accompanying drawings in which.

PREFERRED EMBODIMENT OF THE INVENTION

The present invention bridges between EGM and table games by eliminating any intimidation factor, and offering an easy-to-understand, exciting game that provides a player with relatively greater choice and flexibility. To coincide with and augment this bridging, the optimal physical positioning of the game would desirably be at a point directly between the EGMs and the table games. However, this is by no means critical to the game's success.

The preferred embodiment exemplified below refers to a single concept of a game. The numbers referred to relate to but one of an extensive array of a multiple sets of outcomes that might be applied. It will be appreciated by those skilled in the art that the general "game" concept is inherently flexible, such that changes, alterations and modifications may be introduced at any point/s of the gaming sequence herein described. However, it is the presence of the return means by which a result ball is transferred back to the starting position, thereby to provide for substantially continuous game play with the same odds as the previous game that is an important feature of the present invention.

Figure 1:
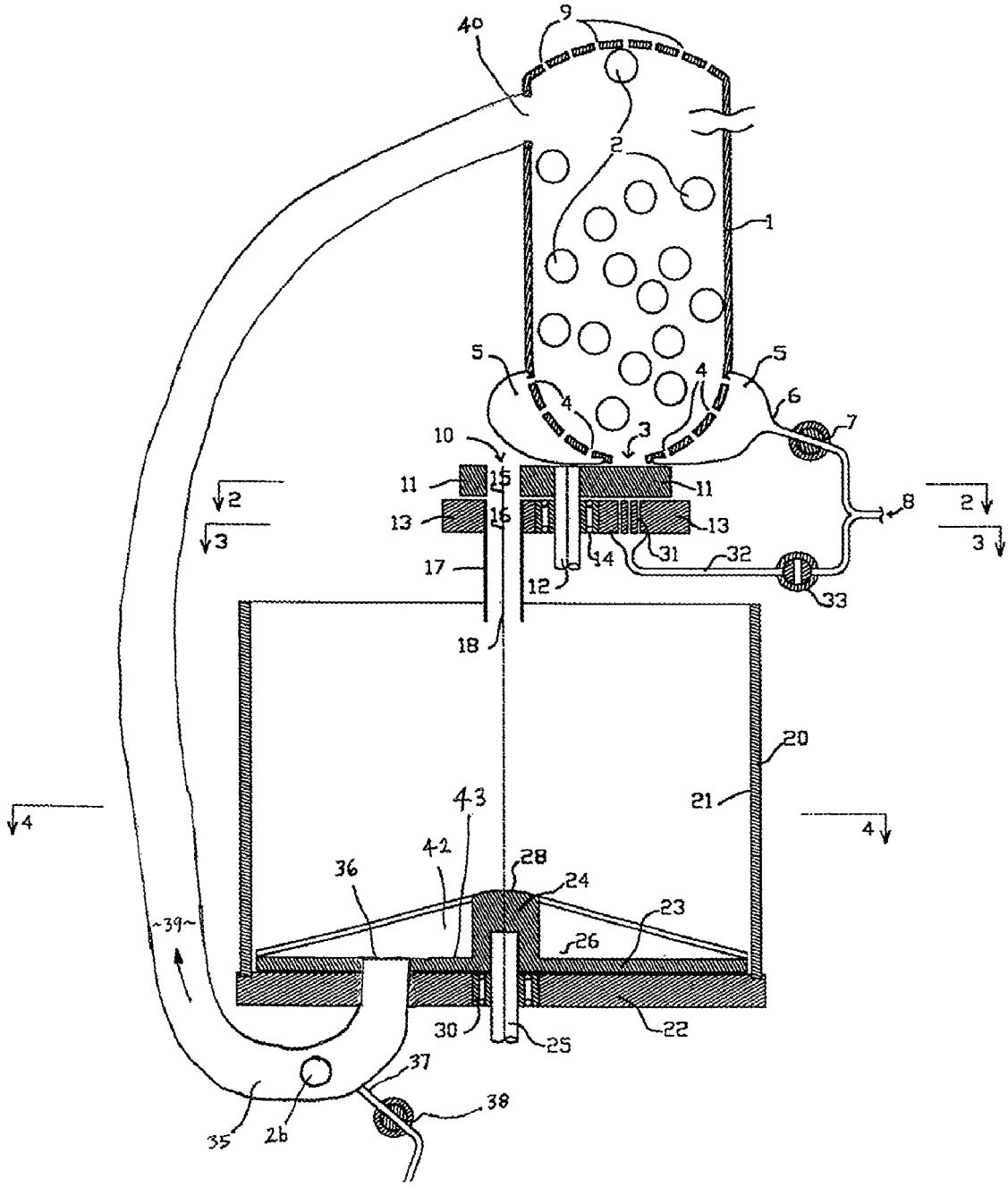
FIG. 1 schematically illustrates a first embodiment of the invention in section in a vertical plane, with the return means providing for efficient return of the ball and relatively enhanced game play.

With reference to FIG. 1, there is shown schematically (and not to scale), the general arrangement according to a first embodiment of the present invention, in a cross-section of a vertical plane. A transparent, generally cylindrical first chamber 1 contains a first set of variously coloured balls 2.

Figure 5:
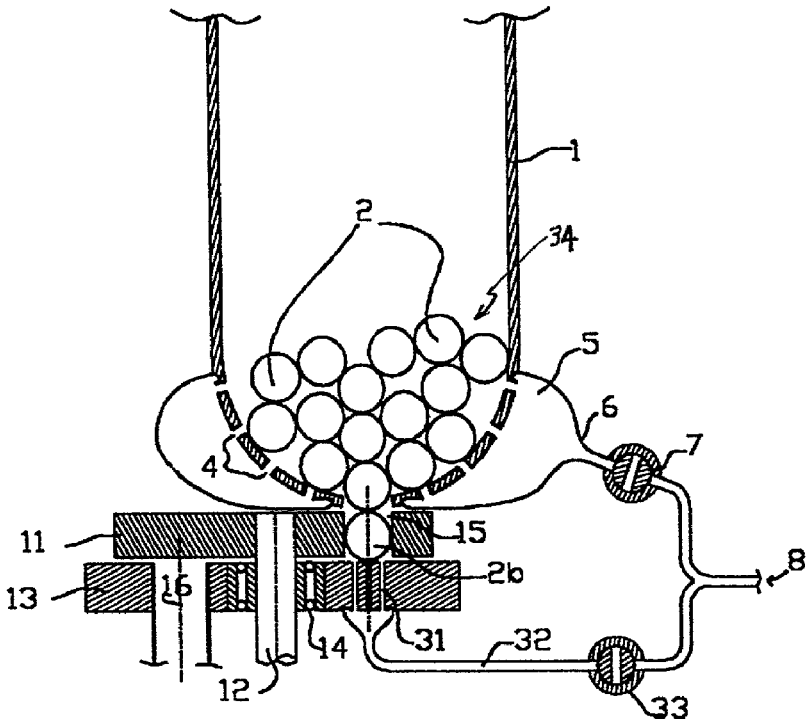
FIG. 5 shows a scrap portion of the embodiment of FIG. 1 in a first stage of operation.

The balls 2 are desirably of a light weight (e.g. hollow) to allow mixing by means of compressed airflow within the chamber 1, and are resilient (e.g. made of plastic). The first chamber 1 has a hemispherical or conical floor draining at its lowest portion to an opening 3, through which any ball 2 may be admitted or discharged from the chamber 1. The floor of chamber 1 is provided with a plurality of openings for air jets 4, which communicate via a manifold 5, tubular connection 6, and valve 7, with a compressed air supply 8. When the valve 7 is opened, as shown in FIG. 1, compressed air is blown into the chamber 1 via jets 4, thereby to levitate the balls 2. The balls 2 resiliently rebound from collisions with each other and/or with the walls of the chamber 1, and are thereby randomly mixed. As best shown in FIG. 5, when the valve 7 is closed, the compressed air supply 8 is terminated, and the balls 2 fall in a random mixture to the floor of the chamber 1.

Figure 2:
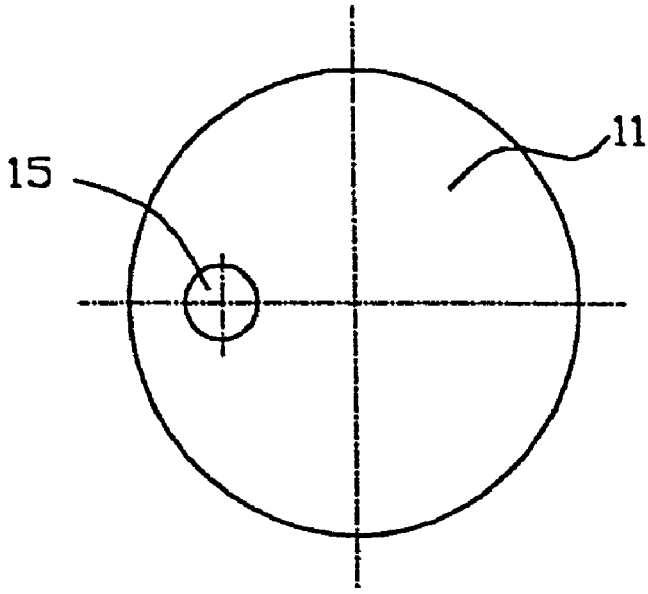
FIG. 2 shows a section on line 2-2 of FIG. 1 viewed in plan.
Figure 3:
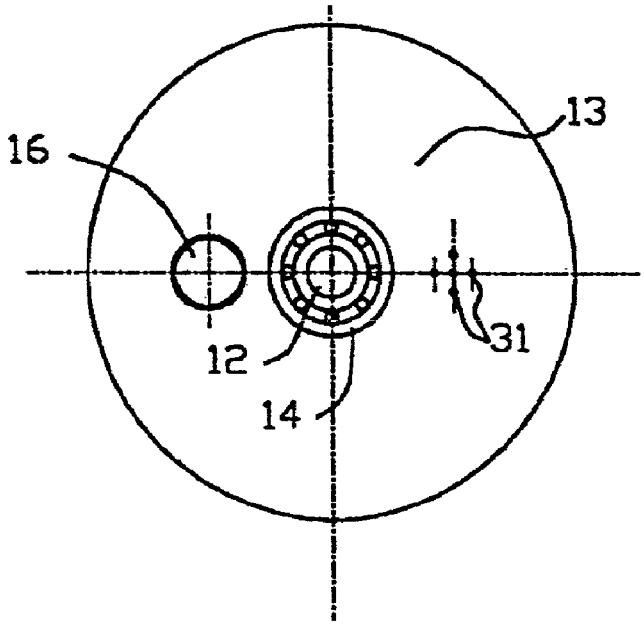
FIG. 3 shows a section on line 3-3 of FIG. 1 viewed in plan.

Referring again to FIG. 1, the opening 3 can be closed by a gate 10. The gate 10 comprises a circular disc 11 mounted to a shaft 12 for driven rotation about an axis parallel to the cylindrical axis of the chamber 1 (FIG. 2). The disc 11 is mounted overlying a plate 13 having an area greater than that of the disc 11 and is separated from the plate 13 by a small clearance. The shaft 12 extends through the plate 13 and is journaled in a bearing 14 mounted to the plate 13. The disc 11 is of a thickness equal to or slightly greater than the diameter of the balls 2 and is penetrated by a bore 15 of a diameter sufficient to receive a single ball 2 with clearance therein.

Figure 6:
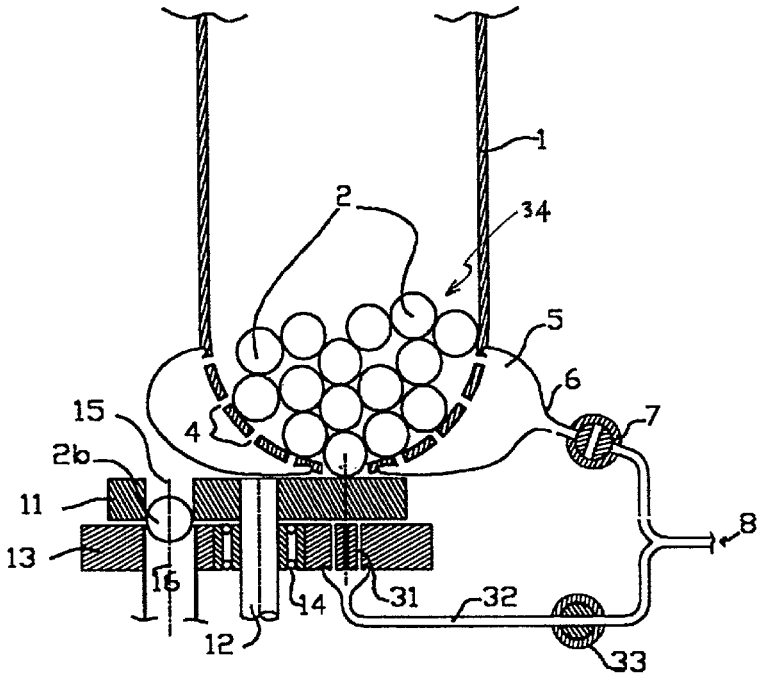
FIG. 6 corresponds to FIG. 5 but in a second stage of operation.

The disc 11 is rotatable via the shaft 12 (by means not illustrated) between a first (or "open", FIG. 5) position, and a second (or "closed", FIG. 6) position. In the first position, the bore 15 of the disc 11 underlies and is in substantial registration with the opening 3 of chamber 1, thereby causing the bore 15 to be "open" to the chamber 1. When the balls 2 are supported by the floor of the chamber 1 (i.e. the balls 2 are not levitated by compressed air 8), a random ball **2*b* may drain into the bore 15 of the disc 11. The disc 11 is then driven via shaft 12 (by means not illustrated) to a second position (which, for clarity in the illustrated embodiment is rotated through 180 degrees from the first position; one will appreciate that the angle of rotation only need be sufficient to return the disc 11 to the "closed" position relative to the chamber 1). The ball 2*b* captive within the bore 15 is then rotated to the second position (FIG. 6). In this position, the bore 15 overlies an orifice 16 in the lower plate 13. When registration of the bore 15 and the orifice 16 is achieved, the ball 2*b* in bore 15 falls through the orifice 16 into a tubular chute 17. When the disc 11 is not in the first position, the disc 11 closes the opening 3 of the chamber 1**.

The tubular chute 17 terminates in an outlet 18 coincident with a second hollow cylindrical chamber 20. The second chamber 20 has a transparent cylindrical wall 21 and a circular floor 22. A wheel 23 having a central cylindrical boss 24 with a circular upper surface 28 is mounted for coaxial driven rotation by a shaft 25 extending axially though an aperture of the cylinder floor 22. The shaft 25 is journaled in a bearing 30 mounted to the floor of the cylinder 20.

Figure 4:
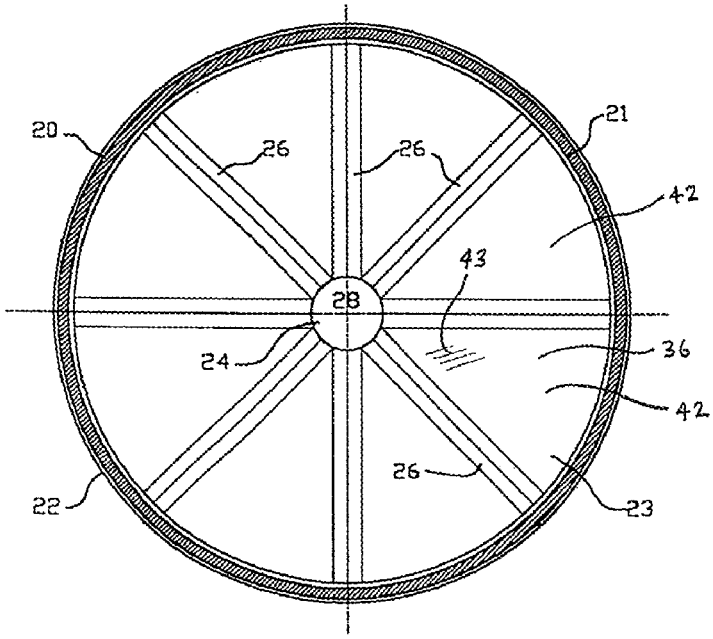
FIG. 4 shows a section on line 4-4 of FIG. 1 viewed in plan.

The wheel 23 is of a clearance diameter less than the internal diameter of the floor 22. As shown in FIG. 4, when viewed from above, the wheel 23 is divided into upwardly open compartments by means of a plurality of walls 26 extending radially from the boss 24 to the periphery of the wheel 23. In a preferred embodiment, there are twenty-five compartments of equal area; each wall is higher nearer the boss 24 than near the periphery. The outlet 18 is centred vertically over the centre of the upper surface 28 of the boss 24 (FIG. 1).

In operation, the chamber 1 initially contains a plurality of balls 2 of various colours. The gate 10 and the valve 7 are both closed.

The game is initiated upon opening the valve 7 and admitting compressed air 8 through the passage 6 and into the manifold 5. The air 8 then enters the chamber 1 via the jets 4, thereby causing the balls 2 to levitate and be flung resiliently against the spherical interior wall of the chamber 1 and/or against other ball/s 2. It will be appreciated that this process randomly mixes the balls 2 in the chamber 1 (FIG. 1). The chamber 1 is further provided with a plurality of vent holes 9, through which spent air 8 exits the chamber 1.

When the balls 2 have been sufficiently randomly mixed, the gate 10 is opened by rotating the disc 11 to align the bore 15 with the opening 3 (FIG. 5). At this time, the wheel 24 in the chamber 20 is set spinning (e.g. by an electric or air-driven motor and clutch (not illustrated), or manually) and the valve 7 (also, valve 33—discussed below) closed, thereby abating the flow of compressed air 8 and causing the balls 2 to fall at random to the floor of the chamber 1. One such ball, designated **2*b* in FIGS. 5 through 7, falls into the bore 15 and is supported on the plate 17. The disc 11 is then rotated (by means not illustrated) to the second position (FIG. 6) in which the bore 15 is in registration with the orifice 16. The ball 2***b* thereby falls through the orifice 16, into the chute 17 and exits the outlet 18. By such means, a single ball 2*b* is selected at random from the plurality of available balls 2 within the chamber 1.

Figure 7:
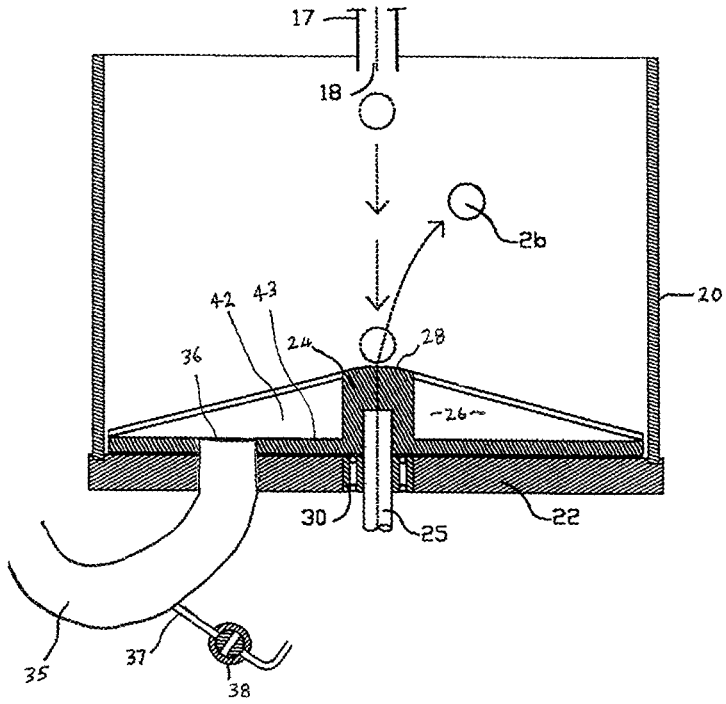
FIG. 7 shows a scrap portion of FIG. 1 in a third stage of operation.

The selected ball 2*b* falls downwardly onto the flat surface 28 of the wheel 23 (FIG. 7). Preferably, the elastic resilience of the ball 2*b* is such that upon striking the surface 28, it rebounds upwardly therefrom. An imperfectly symmetrical exit from the outlet 18, latent spin, or other factors cause the rebounded ball 2*b* to fall directly onto the wheel 24, or be flung against the cylinder wall 21 before falling back toward the wheel 24. The ball may subsequently bounce from collision with the boss, the floor of the wheel 24, or from collision with the partition walls 26. However, as the wheel slows, the ball will eventually settle at random in one of the (preferably twenty-five) compartments defined between the walls 26. This selection process is somewhat similar to the means by which a roulette ball is eventually selected.

The compartment in which the randomly selected ball 2*b* remains determines the result of the game. A player may wager on which coloured ball is selected from chamber 1; on which compartment the ball 2*b* settles; or on the combination of ball 2*b* and compartment.

The plate 13 is desirably provided with air vents 31 connected to the air supply 8 via a tube 32 and either the valve 7, or an independent valve 33. This allows the bore 15 to be cleared of any residual ball 2 prior to closing the gate 10 from the open to the closed position.

Although for illustrative simplicity, only a few balls are shown in the embodiments of FIGS. 1, 5 and 6, in a preferred embodiment of the invention there are eighty-eight balls in the chamber 1; the spinning wheel 24 has twenty-five compartments.

The eighty-eight balls may be of various colours, for example:

| COLOUR | NUMBER |
|---|---|
| Red | 39 |
| Green | 25 |
| Purple | 15 |
| Orange | 8 |
| "Striped" | 1 |
| Total | 88 |

Accordingly, when one coloured ball 2*b* falls onto the wheel 24, a successful bet on the colour of the ball pays the following odds:

| NUMBER | COLOUR | ODDS PAID | HOUSE % PROFIT |
|---|---|---|---|
| 39 | Red | 1/1 | 11.4 |
| 25 | Green | 2/1 | 14.8 |
| 15 | Purple | 4/1 | 14.8 |
| 8 | Orange | 8/1 | 18.2 |
| 1 | "Striped" | 70/1 | 19.3 |

The compartments on the wheel 24 are numbered "1" through "24"; the twenty-fifth 25th number being striped. For a player betting on the destination of the ball on the wheel, the odds for successful selection of any compartment are 20/1 and the house profit is 4%.

Players may enjoy significantly greater odds by betting on a combination of colour and number. For example, assuming a bet that a particular colour of ball falls into a particular identified compartment the odds paid are:

| COMBINATION | ODDS PAID | HOUSE % PROFIT |
|---|---|---|
| Red on particular number | 40/1 | 31.0 |
| Green on particular number | 60/1 | 27.9 |
| Purple on particular number | 80/1 | 41.1 |
| Orange on particular number | 100/1 | 63.3 |
| Stripe on particular number | 888/1 | 59.6 |

Players can thus choose to wager against low, moderate or high odds. The margin of return to the house or to the player can be easily adjusted by variation of either the numbers of balls, the proportion of a particular colour of ball, etc. In addition, jackpot prizes can be paid.

It will be understood that in other embodiments of the invention, the balls may be mixed randomly by other means, such as shaking or by rotation in a closed container. In a preferred embodiment of the invention, the balls 2 are circulated by air pressure 8 until randomly distributed in a transparent container 1 shaped to correspond to the word "fortune" or to a character or ideograph conveying that meaning.

Alternatively the balls can be circulated in a container of cylindrical cross-section which forms the "O" of "FORTUNE" or of tubular shape which forms the "I" of "WIN". Those skilled in the art will appreciate that devices such as "FORTUNE" and "WIN" are useful and effective marketing tools. Alternatively, rather than "FORTUNE" and "WIN", there exists a distinct market opportunity to link the system according to the present invention with any already approved and licensed ball-drawing device, franchise, trade mark, or system.

The container 1 may be equipped with any suitable means by which a single ball 2*b* may be selected automatically and at random. In other embodiments, the container 1 may be equipped with variants of the illustrated components such that the same functional effect is attained, viz. a single randomly selected ball 2*b* is selected and exited from the container 1. For example, as in the game "Lotto", as shown on television, a single ball selected at random may be cupped by arms at the mouth of a hollow tube which is driven upwardly from the floor of a container through a pile of balls until the selected ball is held above the level of the remainder. Thereupon, the arms pivot outwardly, releasing the ball to fall into the hollow tube. The randomly selected ball is then conducted out of the container. Any other suitable means for selecting a single ball at random may be substituted. Desirably, the selection means is suitably automated. Usually, the selection will be actuated by a "Game Compere", at a time after the random mixing has commenced, to ensure that substantial randomisation has occurred. However the selection may be made after a time interval chosen at random, or by other means. The chamber 1 may be provided with a filling port to facilitate replacement of balls.

In the embodiments described, the first set of elements are balls divided into subsets by colour and the destinations are compartments on a roulette-type wheel, distinguishable by number.

It will be understood that the elements of the first set need not be balls; non-spherical set members, e.g. cylindrical, could be employed. Nor need the subsets be distinguished by colour, e.g. the subsets could be distinguishable one from another by numerals or other indicia. The number of elements constituting the first subset, the number of subsets, and the number of members within each subset is a matter of choice, provided that there are at least 2 subsets.

Likewise, the wheel may have any number of compartments, i.e. "destinations", and these may be associated with colours, e.g. red and black, as well as, or instead of, numbers. There may be any suitable number of destinations in the second set; these may be divided into any number of subsets, each subset having one or more members identified by colour, pattern, indicia, or any other means. Although, in the embodiment described, the surface 28 of the boss 24 rotates with the wheel 23, in other embodiments, a stationary surface 28 may be provided. Accordingly, the wheel 23 is spun about a bearing on a stationary boss 24. Alternatively, a surface 28 may be driven in counter rotation to the wheel 23, e.g. by means of a concentric counter rotation axle.

Although it is preferred that the randomly selected ball bounces a number of times before settling in a compartment (and preferably bounces in the vertical plane), in other embodiments, the randomly selected ball from the first compartment may be discharged tangentially into a roulette-type wheel before becoming associated at random with another slot of the roulette-type wheel.

The destinations of the second set need not be associated with a wheel; other apparatus fulfilling a similar function may be used. For example, a vibrating board provided with a set of pockets, or a pinball board arrangement with various channels could be used. In such cases, the randomly selected ball of the first set falling onto the board would be received in one or another pocket or channel destination at random.

Although in the embodiment described, the wheel 23 is set spinning, in other embodiments, the wheel may be stationary and reliance is placed on random bouncing and/or rotation of the surface 28 to produce a random association with a compartment.

It will be understood that although the first chamber is described as "cylindrical", it may in fact, be spherical, or of a different shape. The walls need not be transparent, and instead, the chamber may be provided with suitable windows.

Likewise, although the chamber 20 is described as "cylindrical", it may be of other suitable cross-sections, e.g. a polygon in plan, and may be provided with suitable veins or baffles to change the direction of ball bounce. Although in the described embodiment, the compartments are "segment-shaped" and of equal area, they need not be. In such instances, it will be appreciated that the odds may be altered accordingly.

In a preferred method of playing the game according to the invention, the apparatus is televised and players (in a TV studio, a casino, on-line, viewing the game on television screens at home, in clubs, hotels, TABs, or the like) are at liberty to place bets upon the outcome of the game. In a particularly preferred mode of operation, the game is adaptable to be played on an Electronic Gaming Machine (EGM), such as a "poker machine". Bets can be placed by land-line telephone, mobile phone, interactive cable TV, direct computer linkage, over the internet, or by conventional means using TAB, club, or hotel facilities (where this is legal and/or where suitable credit arrangements have been made).

The inventive concept is also amenable to electronic games at casinos, being other than EGMs, e.g. poker machines. The concept is also applicable to internet betting, by way of virtual casinos or virtual tables.

An example of a casino game other than an EGM is "Rapid Roulette", a hybrid mechanical game, where a roulette wheel and operator sit within a group of computer terminals operated by punters. The punters place bets by selecting the outcome and stake on their personal screens via touch-screen or button-pressing means. Their balance is updated automatically once the spin is complete. The individual screens thus replace the table, and the frequency of game play is increased such that the dealer does not need to calculate, count and pay out winners him/herself. Accordingly, it is envisaged that the present inventive concept is readily transferable to any electronic gaming concept within a casino, including, but by no means limited to a poker machine.

If desired, the game can be played repeatedly, at intervals. If desired, the game can be transmitted via the internet and can be played by computer users.

If the game is used for betting purposes, the winning combinations, and the pay-out ratios may be altered as desired.

The invention also provided return means such that the selected ball 2*b* is returnable to a starting position 34 (FIG. 5) for commencement of a subsequent game having the same odds as the previous game. The return means are best exemplified with reference to FIG. 1, in which the return means is an air conduit 35 fluidly communicable with a floor portion 36 on the wheel 23, and the starting position 34 within the chamber 1. In this illustration, the floor portion 36 is a false bottom, which can be opened, thereby to allow the ball 2*b* to fall, under gravity, into the conduit 35.

An air vent 37 is then actuated via a valve 38. The resultant stream of compressed air 39 thereby propels the ball 2*b* up the conduit 35, through an opening 40 in the chamber 1 and back to the starting position 34. It will be appreciated that such efficient return of the ball 2*b* enables a relatively high rate of game play. Alternatively, the valve 38 may be constantly open, such that even quicker ball return is facilitated.

The return means does not have to be an airlift as described above. Upon falling through the false bottom 36, the ball 2*b* may be mechanically lifted by an arm 41 (not shown) to the starting position 34.

In another embodiment, the ball is propelled by a resiliently biased means, such as a spring loaded device. Any known ball return means may be employed within the scope of the present invention.

The false bottom 36 may be compartmentalised, such that each individual destination compartment 42 has its own unique false bottom. In such an instance, a corresponding number of conduits may meet at a common conduit 35 for return of the ball 2*b* to the starting position 34. Alternatively, each false bottom may have its own unique conduit 35.

Alternatively, a single false bottom 36 would require the wheel 23 to rotate such that the ball 2*b* is adjacent the single false bottom 36, in a manner analogous to the rotation of the disc 11 to deposit the ball 2*b* through the slot 16 in the plate 13. Although this additional rotation step would potentially slow subsequent return of the ball 2*b*, and thereby subsequent game play, it may be preferable to minimise the bulk and complexity of the apparatus.

The return means does not have to be operable through the false bottom 36 in the wheel 23. In an alternative embodiment (not shown), the ball 2*b* is airlifted directly from its resting position in the destination compartment 42 to the starting position 34.

It will be appreciated that the return means can be actuated manually or automatically. The automatic return means is foreseeably operable upon the ball 2*b* residing within the destination compartment 42 for a predetermined time. The predetermined time can be measured with a sensor 43 resident within each destination compartment.

In another embodiment, the invention extends to electronic versions of the game in which a first set of elements divisible into two or more subsets are depicted on a computer screen or the like. Means are provided whereby one element may be selected at random and then associated with one of a plurality of "destination" depictions. In such an embodiment, the return means may be actuated via mouse-click such that the ball 2*b* is instantaneously returned to the starting position for subsequent game play.

In another preferred embodiment, the invention need not relate exclusively to number/colour combinations. For instance, the balls may be labelled or inscribed with insignia corresponding to a sporting identity, and slots corresponding to a sporting event or venue. To elaborate, the balls may bear the names or colours of a race horse, e.g. Makybe Diva, with the slots corresponding to particular races, e.g. Melbourne Cup. A match of Makybe Diva and Melbourne cup would pay odds commensurate with the number of balls bearing the insignia, relative to the number of slots designating the Melbourne Cup. This embodiment is envisaged as an ideal way to bridge the gap between TAB or trackside-type gambling and table gambling systems, thereby generating appeal beyond merely the table gambling market. Further examples of such a system may be with reference to the Olympic Games, in which the correct matches Sydney 2000, or Beijing 2008 pay more favourable odds than an incorrect match, for instance, Athens 1996. A further version of this game my embrace the English Premier League, whereby, for example, Manchester United/Old Trafford pays out, whereas Chelsea/St James' Park would not. The game may also be adapted to reflect Chinese, Hangul, Hiragana or Katakana characters, thereby to appeal to the Asian market.

In a further preferred form of playing the game, there are a total of sixty balls and eighteen numbers (numbered 1 through 18). The balls are circulated by air pressure in a large hollow "I" of the word WIN, which is an envisaged marketing device by which the game may be identified.

One of the coloured balls is selected in the manner described above, and removed from the "I" via a ramp leading to a spinning wheel, as per the above embodiments. The ball is dropped onto the spinning wheel, and once the selected ball stops on a number, the game is over. Return means are then provided so as to return the selected ball to the start position.

In this preferred embodiment, the colour distribution of the balls is:

| | |
|---|---|
| Red | 29 |
| Green | 19 |
| Purple | 11 |
| Gold | 1 |
| Total | 60 |

A player can bet three ways: according to colour, number, or the combination of colour and number. Odds paid are commensurate with probability, and may be summarised as follows:

| Colour | Number of Balls | Select Colour Takeout | Select Colour Payout | Select Combination Takeout | Select Combination Payout |
|---|---|---|---|---|---|
| Red | 29 | 3.3% | 1/1 (evens) | 16.8% | 30/1 |
| Green | 19 | 5.0% | 2/1 | 17.3% | 46/1 |
| Purple | 11 | 8.3% | 4/1 | 17.5% | 80/1 |
| Gold | 1 | 6.7% | 55/1 | 17.7% | 888/1 |
| Mean | | 4.8% | | 17.1% | |

The house take percentages expressed in this document have been verified by Professor Graham Wood, Head of Statistics, Division of Economic and Financial Studies, Macquarie University, Sydney, Australia.

As there are eighteen numbers in total, the odds payout of selecting a number is 16/1. The mean takeout for number play is 5.6%. For the combination bet, the aggregate is 1080 (being 18×60). Thus, there are 94 opportunities to bet on the game.

Qualitative consumer research has been conducted in Sydney and Melbourne, Australia. Eight game play sessions were conducted with table game players and EGM players, who regularly visit casinos. This research was conducted by gambling sector specialists Colmar Brunton, and was moderated by Peter Harris, who has eighteen years' experience in new game development. Consumer response has been extremely positive. The key strengths of the game were perceived to be:

- The three different ways to play (numbers, colours, or combination);
- Players have a "double chance" to win (i.e. a colour is drawn first, followed by a number), which prolongs a sense of anticipation;
- Similarities to Lotto and Roulette confer a sense of familiarity;
- Simplicity, relative to the majority of table games, which have a complex set of rules that can often intimidate and discourage punters;
- Appeal to a broad change of punters; and
- A range of odds is offered to punters (i.e. 1/1 through 888/1).

The rational and emotive reasons as to why EGM and table players would opt to play a game such as that offered by the present invention include: variety, excitement, simplicity, non-intimidation, sociability, and the option of a range of involvement.

In 2003, the well-known market analyst Lily Kwong was quoted as saying that her research showed the average retention per table in Australia was $3000/day. It is estimated that the daily average retention for the game of the present invention will be of the order of $5880/day. These calculations are based upon the following assumptions:

- The apparatus is located on the general pit floor adjacent the EGMs;
- The average number of players/spin over a 24 hour day is six;
- The dealer averages 25 spins/hour, i.e. 600 spins/day;
- The table bet sizes vary between $5 and $500, based on colour, only;
- The average bet/spin/player is $15 for numbers or colours; and $5 for combination bets, i.e. colour and number;
- The number of bets is split evenly between colour or number and colour plus number, i.e. three players on colours or numbers and three on combinations;
- The colour or number players average two bets each, one on a colour and one on a number, whereas the combinations players average two bets each; and The average player has a bank of $100.

Play and House Retention Calculations

Source: A. J. Windross, M A (Hons) (Gambling Studies)—former C.E.O of TAB Limited (Australia)

| | $ played (numbers) | $ house retain | $ played (colours) | $ house retain | $ played (combination) | $ house retain | $ total played | $ total house retain |
|---|---|---|---|---|---|---|---|---|
| Per Spin | 45 | 2.5 | 45 | 2.17 | 30 | 5.13 | 120 | 9.7 |
| Per Hour | 1,125 | 62.5 | 1,125 | 54.25 | 750 | 128.25 | 3,000 | 245 |
| Per Day | 27,000 | 1,500 | 27,000 | 1,302 | 18,000 | 3,078 | 72,000 | 5,880 |

Playtime experiences are calculated using exhaustion tables decremented by the retention rates. A punter on "colours", starting with a $50 bank and betting $15/spin would average 25 spins over one hour before more than $35 was lost, i.e. the punter is unable to stake $15 on spin number 26.

A punter on "numbers", starting with a $50 bank and betting $15/spin would average 22 spins over approximately 53 minutes before more than $35 was lost, i.e. the punter is unable to stake $15 on spin number 23.

A punter on "combinations", starting with a $100 bank and betting $10/spin would average 13 spins over approximately 31 minutes before more than $40 was lost, i.e. the punter is unable to stake $10 on spin number 14.

It will be appreciated that the illustrated system provides a new game that is easy to play and provides an alternative to known games. It will be further appreciated that the illustrated system provides for a substantially continuous or regenerable game, wherein the result ball is automatically and efficiently returned to its start position upon completion of a game, thereby to enable a subsequent game to be started almost immediately.

Although the invention has been described with reference to specific examples, it will be appreciated by those skilled in the art that the invention may be embodied in many other forms.

Unless the context clearly requires otherwise, throughout the description and the claims, the words 'comprise', 'comprising', and the like are to be construed in an inclusive sense as opposed to an exclusive or exhaustive sense; that is to say, in the sense of "including, but not limited to".

The claims defining the invention are as follows:

1. Gaming apparatus adapted for substantially continuous play, said apparatus comprising:

a first set of elements divisible into two or more distinguishable subsets, thereby to define a start position;

a second set of destinations divisible into two or more distinguishable subsets;

selection means for selecting at random one element from said first set;

association means for associating said randomly selected one element at random with one said destination of said second set; and return means for returning said randomly selected one element to said start position.

2. Gaming apparatus according to claim 1 wherein said first set of elements is a plurality of balls.

3. Gaming apparatus according to claim 2 wherein said set of balls is divided into a plurality of subsets, each subset being distinguishable from a respective other subset.

4. Gaming apparatus according to claim 1 wherein said second set of destinations is a set of compartments or slots defined on a wheel.

5. Gaming apparatus according to claim 4 wherein each said destination is distinguishable from respective other destinations by means including, but not limited to: numerical indicia, names of people, places, things, and symbols, such as flora and fauna icons.

6. Gaming apparatus according to claim 4 wherein said wheel is radially partitioned into segment-shaped upwardly open compartments.

7. Gaming apparatus according to claim 4 wherein said first set of elements are balls, and wherein one said ball selected at random from said first set is allowed to travel in a path which includes at least one random bounce prior to said randomly selected ball settling at random in one of said compartments.

8. Gaming apparatus according to claim 4 wherein said wheel comprises a central boss.

9. Gaming apparatus according to claim 4 wherein said return means is an airlift, thereby to lift and deposit said ball from said destination compartment to said starting position.

10. Gaming apparatus according to claim 4 wherein one or more said destination compartments comprise a false bottom, said false bottom selectively openable to allow passage of said ball into said return means for deposit to said starting position.

11. Gaming apparatus according to claim 7, further comprising means to set said wheel in rotation prior to allowing said randomly selected ball to settle at random into one of said compartments.

12. Gaming apparatus according to claim 7 wherein said randomly selected ball bounces in a substantially vertical plane prior to settling at random into one of said compartments.

13. Gaming apparatus according to claim 8 wherein said central boss rotates with said wheel.

14. Gaming apparatus according to claim 8 wherein said central boss counter-rotates with respect to said wheel.

15. Gaming apparatus according to claim 10 wherein said return means is an air conduit.

16. Gaming apparatus according to claim 10 wherein said return means comprises mechanically lifting and depositing said ball in said starting position.

17. Gaming apparatus according to claim 1, said apparatus further comprising:

a chamber;

means for randomly mixing said first set of elements in said chamber; and means for removing one randomly-selected element from said chamber.

18. Gaming apparatus according to claim 1 wherein said return means is manually operable.

19. Gaming apparatus according to claim 1 wherein said return means is automatically operable.

20. Gaming apparatus according to claim 19 wherein said automatically operable return means is actuated at predetermined intervals.

21. Gaming apparatus according to claim 20 wherein said predetermined intervals correspond to the time said ball resides in said destination compartment.

22. Gaming apparatus according to claim 21 wherein said time said ball resides in said destination compartment is determined by a sensor within each said destination compartment.

23. A gaming concept, said concept comprising:

adapting the apparatus according to claim 1 to an electronic gaming format;

enabling one or more punters to bet singularly or simultaneously upon an outcome, said outcome having predefined odds; and automatically assessing each said outcome relative to each said bet and said odds, thereby to facilitate automatic electronic payment of a winning stake corresponding to said predefined odds.

* * * * *